US006223916B1

(12) United States Patent
Enos

(10) Patent No.: US 6,223,916 B1
(45) **Date of Patent: *May 1, 2001**

(54) SHELVING CROSSBAR RETAINER AND ASSEMBLY AND METHOD FOR FIXING A CROSSBAR TO A POST

(76) Inventor: Barry M. Enos, 168 Seven Star Rd., Groveland, MA (US) 01834

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/110,758

(22) Filed: Jul. 3, 1998

(51) Int. Cl.[7] ..... A47B 43/00
(52) U.S. Cl. ..... 211/187; 248/242
(58) Field of Search ..... 211/186, 187, 211/183, 192; 248/242, 243, 245, 220.42, 220.21, 221.11, 222.14, 225.11, 225.21, 241, 250, 274.1

(56) References Cited

U.S. PATENT DOCUMENTS

| | | | | |
|---|---|---|---|---|
| 2,937,767 | * | 5/1960 | Butler et al. | 211/187 |
| 3,080,980 | * | 3/1963 | Gibbons | 248/242 |
| 3,724,678 | * | 4/1973 | Challier | 211/187 |
| 3,749,432 | * | 7/1973 | Janssen | 52/238 |
| 3,858,988 | * | 1/1975 | Cohen | 211/148 |
| 3,888,440 | * | 6/1975 | Rebentisch | 248/222.13 |
| 3,891,262 | * | 6/1975 | Brunel | 211/192 |
| 4,004,856 | * | 1/1977 | Wesseler | 211/177 |
| 4,098,480 | * | 7/1978 | Neumann | 248/243 |
| 4,106,738 | * | 8/1978 | Kostecky | 211/192 |
| 4,265,502 | * | 5/1981 | Blodee et al. | 211/192 |
| 4,317,523 | * | 3/1982 | Konstant et al. | 211/187 |
| 4,352,587 | * | 10/1982 | Milz | 211/192 |
| 4,378,925 | * | 4/1983 | Griffin | 248/242 |
| 4,406,374 | * | 9/1983 | Yedor | 211/192 |
| 4,567,698 | * | 2/1986 | Morrison | 211/192 X |
| 4,693,383 | * | 9/1987 | Fenwick | 211/192 |
| 4,708,252 | * | 11/1987 | Azzi | 211/192 |
| 4,850,285 | * | 7/1989 | Suttles | 211/187 |
| 4,914,878 | * | 4/1990 | Tamaki et al. | 211/192 X |
| 4,955,743 | * | 9/1990 | King | 211/192 |
| 4,972,783 | * | 11/1990 | Crissman et al. | 211/192 |
| 5,069,263 | * | 12/1991 | Edwards | 211/197 X |
| 5,377,851 | * | 1/1995 | Asano et al. | 211/192 |
| 5,433,327 | * | 7/1995 | Benvenuti et al. | 211/187 X |
| 5,605,238 | * | 2/1997 | Jacobs | 211/187 |
| 5,642,593 | * | 7/1997 | Shieh | 211/187 X |
| 5,899,035 | * | 5/1999 | Waalkes et al. | 211/192 |

* cited by examiner

*Primary Examiner*—Daniel P. Stodola
*Assistant Examiner*—Jennifer E. Novosad
(74) *Attorney, Agent, or Firm*—Pandiscio & Pandiscio

(57) ABSTRACT

A shelving crossbar retainer, assembly, and method for retaining a crossbar having an edge surface extending lengthwise thereof, the crossbar having a hook portion on an end thereof for insertion into a vertical slot in a post for supporting shelving and the crossbar, the post being hollow and having a horizontal slot disposed therein for alignment with the crossbar edge surface, the crossbar retainer including a body portion for disposition on the crossbar edge surface proximate the end of the crossbar, attachment structure extending from the body portion for locking engagement with the crossbar edge surface for securing the body portion to the crossbar, and a tab extending from the body portion and adapted to extend beyond the crossbar end for disposition in the horizontal slot, to secure the crossbar hook portion substantially immovably in the vertical slot.

15 Claims, 6 Drawing Sheets

SHELVING CROSSBAR RETAINER AND ASSEMBLY AND METHOD FOR FIXING A CROSSBAR TO A POST

FIELD OF THE INVENTION

This invention relates to the interconnection of components of mechanical assemblies, and is directed more particularly to a retainer for fixing a shelving crossbar to a shelving post, a shelving assembly including the retainer, and a method for fixing a shelving crossbar to a shelving post.

BACKGROUND OF THE INVENTION

In the field of shelving assemblies, it is known to attach shelves and reinforcing crossbars to hollow posts by inserting hook portions on the shelves and crossbars into vertical slots in the posts. The slots are of a length sufficient to accept the entire hook portion, but once the hook portion is inside the post, only a limited part of the hook portion is actually disposed in the slot, leaving a large portion of the slot unoccupied, contributing to a looseness or abundance of "play" in the structure of assembled units. Once the shelves are loaded with books, equipment, or the like, the weight stabilizes the shelf hook portions in the post slots. However, the crossbars, which are intended to add to the structural stability of the assembled unit, are only loosely connected to the posts.

Thus, there is a need for an arrangement similar to the known arrangement described above, and therefore easy to assemble, but including means for stabilizing the interconnection of the crossbars and the posts.

OBJECTS OF THE INVENTION

Accordingly, an object of the present invention is to provide a retainer for use in shelving assemblies for securing the crossbars to the posts such that the crossbar hook portions are substantially immovable in the post slots.

A further object of the present invention is to provide a shelving assembly in which the crossbar hook portions are substantially immovably fixed in the post slots.

A still further object of the present invention is to provide a method for fixing a shelving crossbar to shelving posts in such a manner as to prevent substantial movement of the crossbar hook portions in the post slots.

SUMMARY OF THE INVENTION

These and other objects of the present invention are addressed by the provision and use of a novel shelving crossbar retainer for retaining a crossbar having a lengthwise edge surface, the crossbar having a hook portion on an end thereof adapted for insertion into a vertical slot in a post for supporting shelving and the crossbar, the post being hollow and having a horizontal slot disposed therein for alignment with the crossbar edge surface. The crossbar retainer comprises a body portion for disposition on the crossbar edge surface proximate the end of the crossbar, attachment structure extending from the body portion for locking engagement with the crossbar edge surface for securing the body portion to the crossbar, and a tab extending from the body portion and adapted to extend beyond the crossbar end for disposition in the post horizontal slot, whereby to secure the crossbar hook portion substantially immovably in the post vertical slot.

The objects of the present invention are further addressed by the provision and use of a novel shelving crossbar assembly. The assembly comprises a crossbar having a lengthwise edge surface, a hook portion on an end thereof, and a post for supporting shelving and supporting the crossbar, the post being hollow and having a vertical slot therein for receiving the crossbar hook portion, and the post having a horizontal slot disposed in alignment with the crossbar edge surface. The assembly further includes a retainer comprising a body portion positioned on the crossbar edge surface proximate the crossbar end, attachment structure extending from the body portion and lockingly engaged with the crossbar edge surface, thereby fixing the body portion to the crossbar, and a tab extending from the body portion and beyond the crossbar end and protruding through the horizontal slot and into the hollow post. The crossbar hook portion is thereby substantially immovably fixed in the vertical slot.

The objects of the present invention are still further addressed by the provision of a novel method for fixing a shelving crossbar to a shelving post, the crossbar having an edge surface extending lengthwise thereof, and having a hook portion on an end thereof for insertion into a vertical slot in a post for supporting shelving and the crossbar, the post being hollow and having a horizontal slot disposed therein for alignment with the crossbar edge surface. The method comprises the steps of inserting the crossbar hook portion into the post vertical slot, such that a portion of the hook portion is disposed in the post, and a second portion of the hook portion rests on a lower end of the vertical slot, providing a retainer comprising a body portion having a hole therethrough, and a tab extending from the body portion, placing the retainer body portion on the crossbar edge surface and moving the body portion toward the post to cause the retainer tab to enter the post horizontal slot, providing a fastener which is receivable by the body portion hole and engageable with the crossbar edge surface, and moving the fastener through the body portion hole and into the crossbar through the edge surface thereof, to fix the retainer to the crossbar with the retainer tab in the post horizontal slot, substantially preventing movement of the crossbar hook portion in the post vertical slot.

The above and other features of the invention, including various novel details of construction and combinations of parts and method steps, will now be more particularly described with reference to the accompanying drawings and pointed out in the claims. It will be understood that the particular devices, assembly, and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

The above and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

Figure 2:
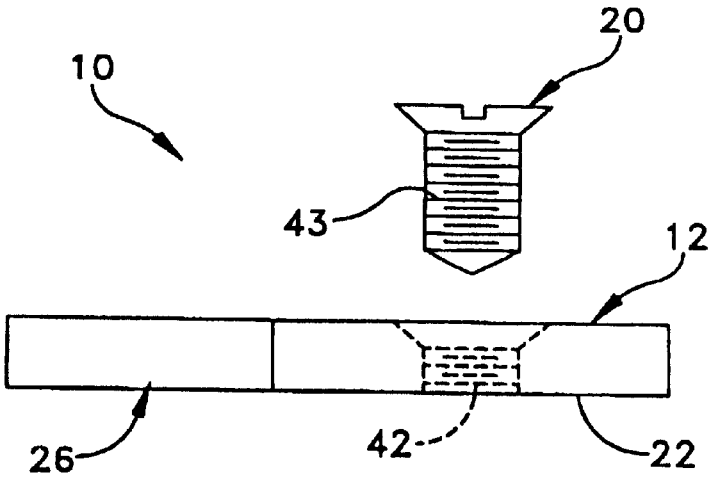
FIG. 2 is a side elevational view of the retainer body portion of FIG. 1 in combination with retainer attachment structure, illustrative of an embodiment of the invention.
Figure 3:
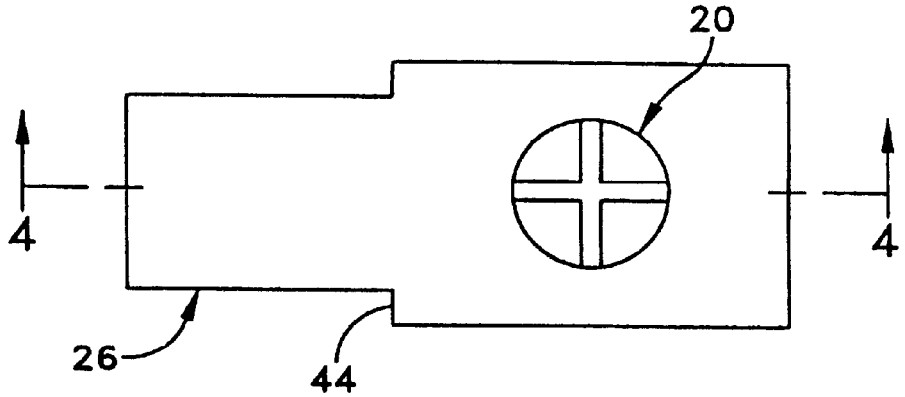
FIG. 3 is a top plan view of the retainer of FIG. 2.
Figure 4:
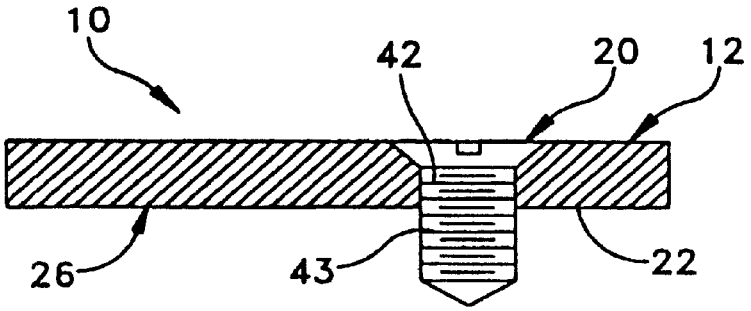
FIG. 4 is a sectional view taken along line 4—4 of FIG. 3.

Referring to the drawings, it will be seen that a shelving crossbar retainer 10 (FIGS. 1–4) includes a body portion 12 for disposition in a groove 14 (FIGS. 6 and 7) in an upper edge surface 32 or, if no groove 14 is present, on the upper edge surface 32 itself (not shown), proximate an end 16 of a crossbar 18. The retainer 10 further includes an attachment device 20, which preferably constitutes a screw, as shown in FIGS. 2–4, but which may be another fastener, such as an expansion bolt. The attachment device 20 extends from an underside 22 of retainer body portion 12 (FIG. 4) for locking engagement with a bottom wall 24 (FIG. 7) of groove 14 in upper edge surface 32 or, if no groove 14 is present, with the edge surface 32 itself, for securing body portion 12 to crossbar 18 (FIG. 7).

Figure 5:
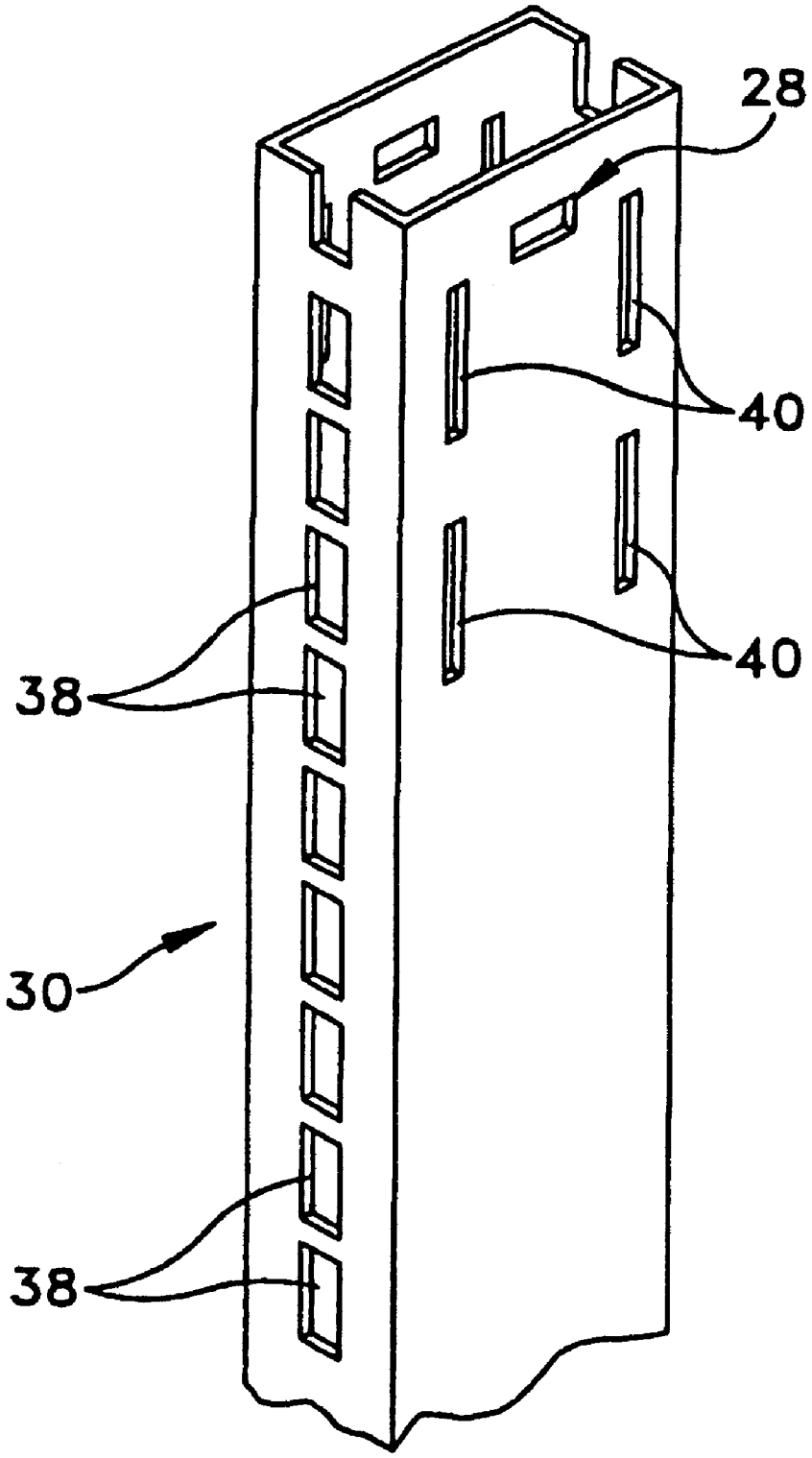
FIG. 5 is a perspective view of a portion of a shelving post of the type with which the retainer of FIGS. 1–4 finds utility.
Figure 7:
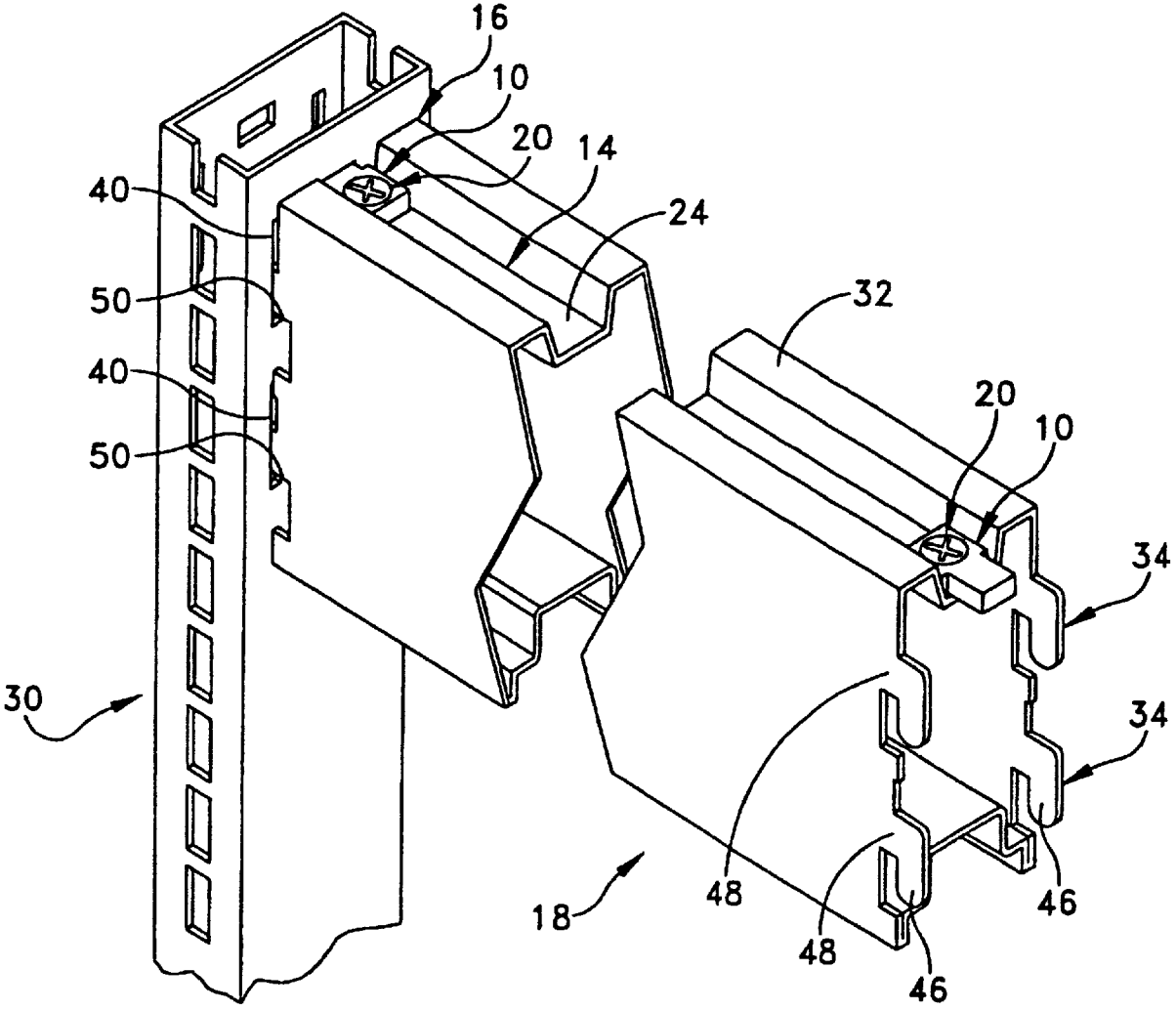
FIG. 7 is a perspective view of the crossbar of FIG. 6 connected to the post of FIG. 5, and the retainer of FIGS. 1–4 fixed to the crossbar and engaged with the post.

The retainer 10 still further includes a tab 26 (FIGS. 1–4) extending from retainer body portion 12 and adapted to extend beyond end 16 of crossbar 18 and for disposition in a horizontal slot 28 (FIG. 5) in a shelving post 30 (FIGS. 5 and 7).

The crossbar 18 includes the lengthwise edge 32 (FIGS. 6 and 7) which, in some instances, is provided with groove 14 extending lengthwise of edge 32. The crossbar 18 is also provided with hook portions 34 at crossbar ends 16 and 36.

Figure 6:
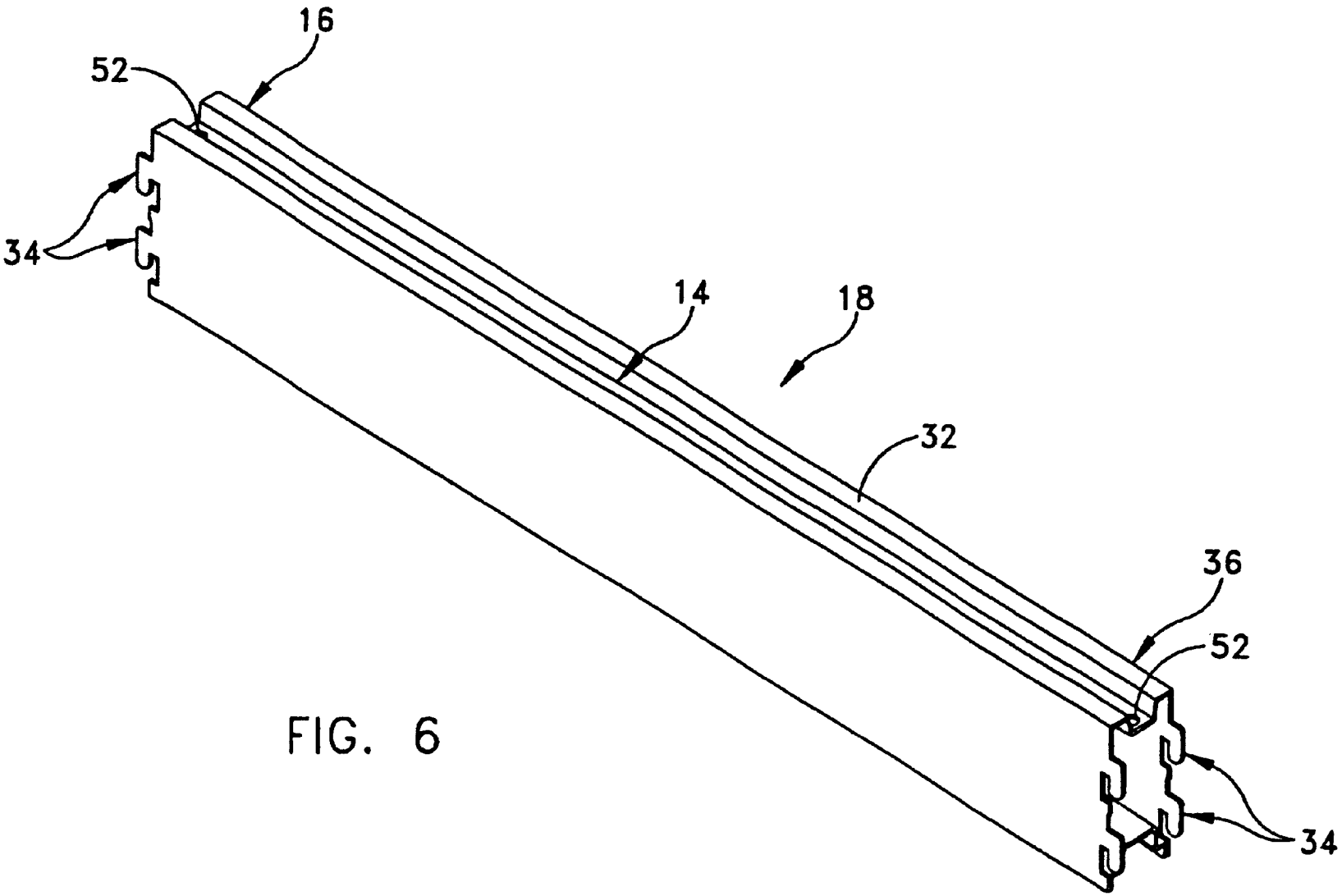
FIG. 6 is a perspective view of one form of a crossbar connectable to the post of FIG. 5.

The post 30 is provided with vertical slots 38 (FIG. 5) for receiving shelf connecting portions (not shown). Post 30 is also provided with vertical slots 40 (FIG. 5) for receiving crossbar hook portions 34 (FIG. 6). The post 30 is hollow, such that the crossbar's hook portions 34 and the retainer's tab 26 may pass through slots 40 and 28, respectively, and pass into the interior of the post.

The retainer 10 preferably is of a planar configuration, as shown in the drawings, but may be of an other configuration, so long as the retainer may be disposed on surface 32, or in groove 14, and tab 26 may enter horizontal slot 28.

When the crossbar surface is provided with groove 14, the retainer body portion is of a width less than the width of groove 14 and is preferably of a height less than the height, or depth, of groove 14. When groove 14 is not provided, the retainer body portion is of a width less than the width of crossbar edge surface 32. Preferably, the body portion 12 and tab 26 are formed together as a single, unitary, integral member, of a rigid material, such as a metal or a rigid plastics material. As seen in FIGS. 1–4, the retainer body portion 12 is provided with a hole 42 extending therethrough and adapted to receive attachment device 20. As noted above, attachment device 20 preferably is a screw and, if so, hole 42 is preferably appropriately threaded for engagement with a threaded shank 43 of the screw (FIGS. 2 and 4).

Figure 1:
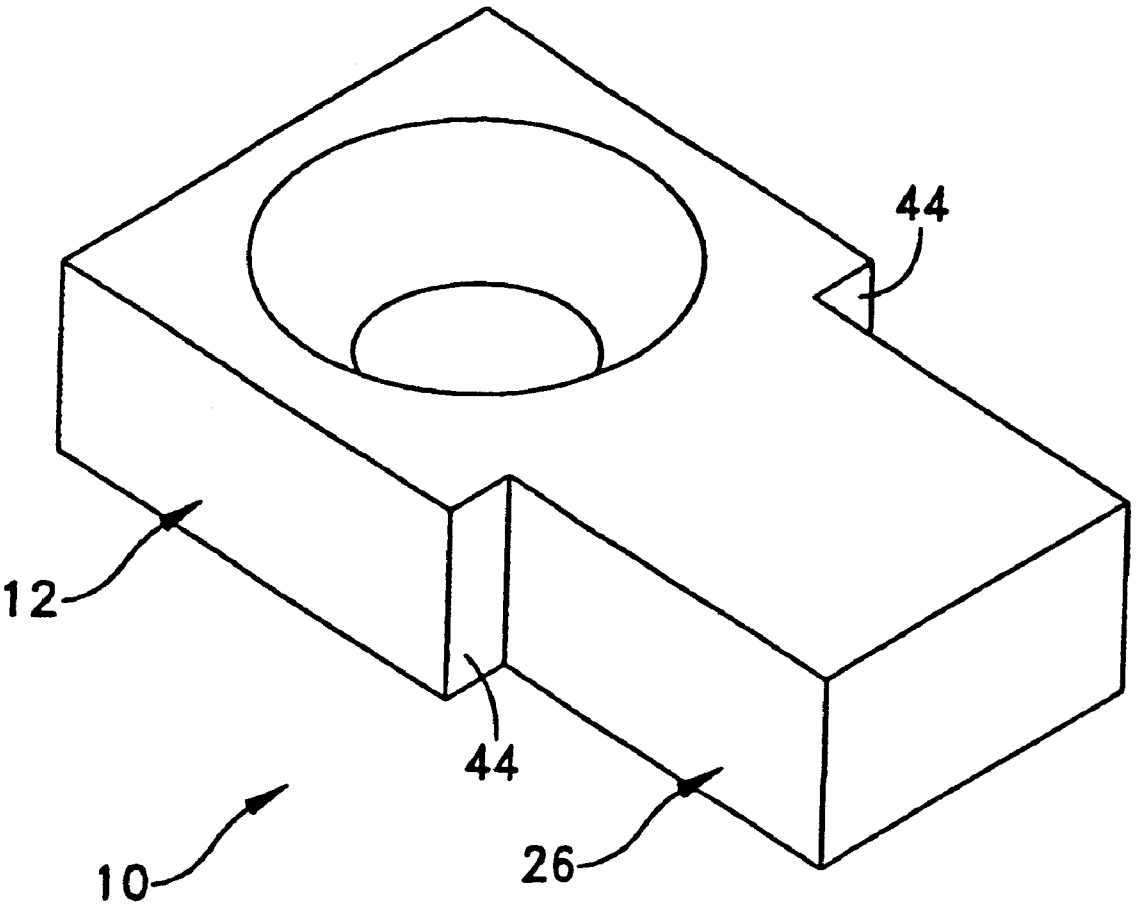
FIG. 1 is a perspective view of one form of shelving crossbar retainer body portion.

Referring to FIGS. 1 and 3, it will be seen that the width of tab 26 may be somewhat less than the width of body portion 12, providing shoulders 44 which assist in placing retainer 10 in the appropriate place in crossbar groove 14 and in post horizontal slot 28, or on crossbar edge surface 32, by placing the shoulders 44 near the end of crossbar 18. Alternatively, or in addition to shoulders 44, screw holes 52 may be provided in crossbar edge surface 32 or, if groove 14 is present, in bottom wall 24 of groove 14 (FIG. 6) at the appropriate place to receive screw 20, thereby properly locating retainer 10.

In one preferred embodiment of the present invention, retainer 10, crossbar 18 and post 30 are formed so that retainer shoulders 44 engage the inner face of post 18 when tab 26 is properly positioned in horizontal slot 28, with a screw extending through retainer hole 42 and into crossbar hole 52. Alternatively, the retainer 10 may be simply rectangular in plan view, without the shoulders 44.

Once assembled, hook portions 34 of crossbar 18 are disposed in vertical slots 40 in post 30. The retainer tab 26 is disposed in horizontal slot 28 and is secured to crossbar 18 by screw 20. Thus, substantial movement of hook portions 34 in slots 40 is prevented, increasing stability of the shelving crossbar assembly.

To erect the aforesaid shelving crossbar assembly, an operator need only insert crossbar hook portions 34 into post vertical slots 40 such that a portion 46 (FIG. 7) of hook portion 34 is disposed within hollow post 30, and a second portion 48 (FIG. 7) of hook portions 34 rests on a lower end 50 (FIG. 7) of vertical slot 40.

The retainer 10 is then placed on crossbar edge surface 32, or in groove 14, and moved toward post 30 to cause tab 26 to enter post horizontal slot 28. The tab 26 is then fixed in place by the screw 20, or other fastener.

Figure 9:
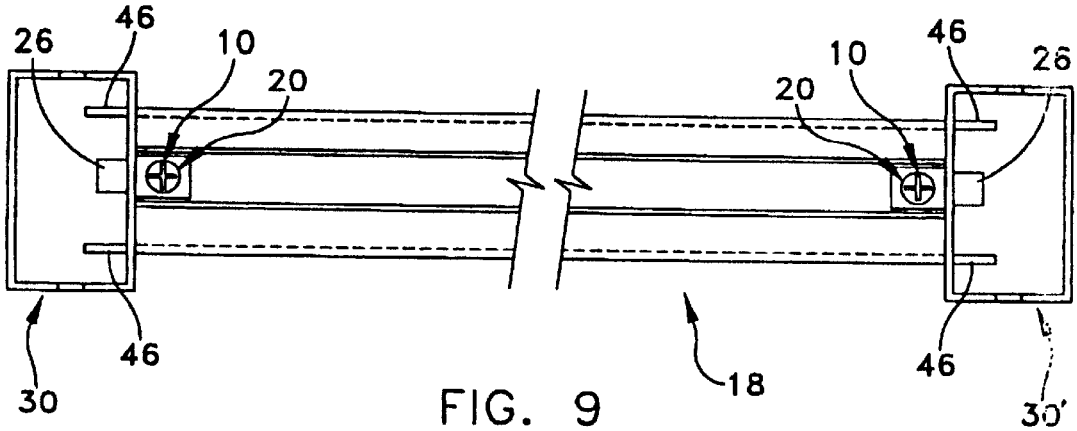
FIG. 9 is a top plan view of the assembly of FIG. 8.
Figure 8:
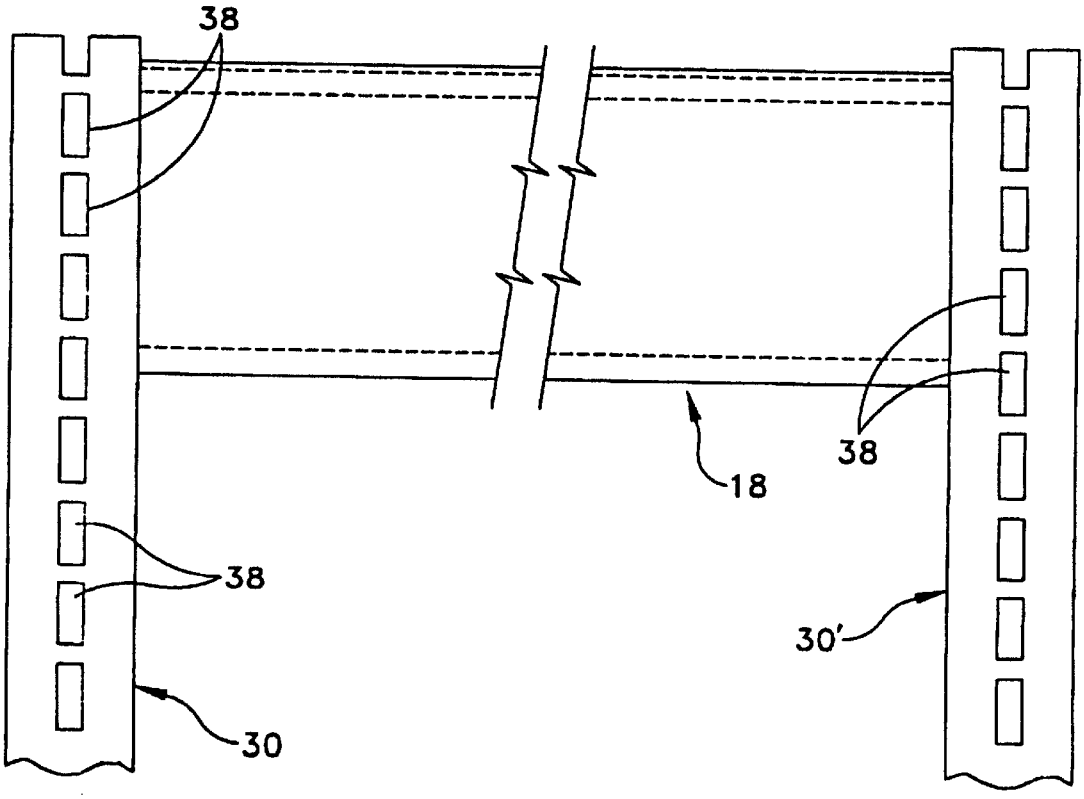
FIG. 8 is a front elevational view showing the crossbar of FIG. 6 connected to two shelving posts of the sort shown in FIG. 5.

While the foregoing has described in detail the manner in which crossbar 10 is attached to post 30, utilizing a hook portion and vertical slot, and a retainer tab and horizontal slot, it will be appreciated that end 36 (FIG. 6) of crossbar 18 is substantially identical and opposite to end 16, and that crossbar 18 is attached to shelving post 30' in the same manner as crossbar end 16 is attached to post 30 (FIGS. 8 and 9). It will be further appreciated that any number of hook portions 34 and vertical slots 40 may be utilized, and that each end of crossbar 18 is preferably provided with a retainer 10.

It should also be appreciated that, while in the figures crossbar groove 14 is shown to extend across the entire length of crossbar 18, groove 14 might only extend along a portion of crossbar 18, i.e., at the two opposing ends 16 and 36 of the crossbar, or groove 14 may be omitted altogether.

There is thus provided a retainer for use in shelving assemblies for securing crossbars to posts such that the crossbar hook portions are substantially immovable vertically in the post vertical slots. There is further provided a shelving assembly in which the crossbars are substantially immovably fixed to the posts. There is still further provided a method for fixing shelving crossbars to shelving posts in such a manner as to prevent substantial movement of the crossbar on the posts.

It is to be understood that the present invention is by no means limited to the particular constructions and method steps herein disclosed and/or shown in the drawings, but also comprises any modifications or equivalents within the scope of the claims.

What is claimed is:

1. A shelving crossbar assembly comprising:

a crossbar having an upper edge extending lengthwise thereof and defining an elongated groove having a bottom wall spaced from an upper edge surface of said crossbar and side walls upstanding from said bottom wall, said crossbar having a hook portion on an end thereof;

a post for supporting shelving thereon and supporting said crossbar thereon, said post being hollow and having a vertical slot therein for receiving said crossbar hook portion, and said post having a horizontal slot disposed in alignment with said groove of said crossbar; and a retainer comprising:

a body portion fixed on said bottom wall of said crossbar groove in between said side walls, and proximate said crossbar end;

a removable fastener extending through said body portion of said retainer and lockingly engaged with said crossbar groove bottom wall, thereby fixing said body portion to said crossbar groove bottom wall;

a tab extending from said body portion and beyond said crossbar end and protruding through said post horizontal slot and into said hollow post; and said crossbar hook portion being thereby fixed in said vertical slot.

2. An assembly in accordance with claim 1 wherein said body portion is substantially planar in configuration.

3. An assembly in accordance with claim 2 wherein said tab is substantially planar in configuration.

4. An assembly retainer in accordance with claim 3 wherein said body portion and said tab each comprise a portion of a unitary integral retainer.

5. An assembly in accordance with claim 4 wherein said retainer is made from metal and is rigid.

6. An assembly in accordance with claim 5 wherein said retainer body portion is provided with a screw hole extending therethrough, and said fastener comprises a screw extending through said screw hole, whereby said screw is engaged with said crossbar groove bottom wall.

7. An assembly in accordance with claim 6 wherein said tab is of a width less than a width of said body portion.

8. An assembly according to claim 6 wherein said crossbar groove bottom wall is provided with a screw hole extending therethrough, and said screw is engageable with said screw hole.

9. An assembly in accordance with claim 1 wherein said fastener comprises a shank extending through said body portion for said locking engagement with said crossbar groove bottom wall.

10. An assembly in accordance with claim 9 wherein said shank extends from an underside of said body portion.

11. An assembly in accordance with claim 1 wherein said fastener comprises a screw extending through said body portion.

12. A method for fixing a shelving crossbar to a shelving post, the crossbar having an upper lengthwise edge defining an elongated groove having a bottom wall spaced from the upper lengthwise edge of the crossbar and side walls upstanding from the bottom wall, said crossbar having a hook portion on an end thereof for insertion into a vertical slot in a post for supporting shelving and the crossbar thereon, the post being hollow and having a horizontal slot disposed therein for alignment with the crossbar groove, the method comprising the steps of:

inserting the crossbar hook portion into the post vertical slot, such that a portion of the hook portion is disposed in the post, and a second portion of the hook portion rests on a lower end of the vertical slot;

providing a retainer comprising:

a body portion having a hole therethrough, and a tab extending from the body portion;

placing the retainer body portion on the crossbar groove bottom wall and moving the body portion towards the post to cause the retainer tab to enter the horizontal slot;

providing a removable fastener which is receivable by the body portion hole and engageable with said crossbar groove bottom wall; and moving the fastener through the body portion hole and into the crossbar through the groove bottom wall, to fix the retainer to the crossbar with the retainer tab in the horizontal slot, substantially preventing movement of the crossbar hook portion in the post vertical slot.

13. A method in accordance with claim 12, wherein the fastener comprises a screw.

14. A method in accordance with claim 12 further including the further step of providing the crossbar with a screw hole for alignment with the retainer body portion hole.

15. A method in accordance with claim 12 and further including fixing the crossbar to a second shelving post, the crossbar having a second hook portion on a second end thereof for insertion into a second vertical slot in the second post having a second horizontal slot disposed therein for alignment with the crossbar groove and further including the steps of:

inserting the crossbar second hook portion into the second post second vertical slot, such that the second hook portion is disposed in the second post;

providing a second removable retainer comprising a second body portion having a second hole therethrough and a second tab extending from the second body portion;

placing the second retainer second body portion on the crossbar groove bottom wall and moving the second body portion toward the second post to cause the second tab to enter the second horizontal slot;

providing a second fastener receivable by the second body portion second hole and engageable with the crossbar groove bottom wall; and moving the second fastener through the second body portion second hole and into the crossbar through the groove bottom wall thereof, to fix the second retainer to the crossbar with the second retainer second tab in the second horizontal slot, substantially preventing movement of the crossbar second hook portion in the second post second vertical slot.

* * * * *